US009885986B2

(12) United States Patent
Uehara et al.

(10) Patent No.: US 9,885,986 B2
(45) Date of Patent: Feb. 6, 2018

(54) FIXING DEVICE AND IMAGE FORMING APPARATUS COMPRISING A THERMAL FUSE INCLUDING A FUSE ELEMENT SUPPORTED BY AN ELASTIC MEMBER

(71) Applicant: FUJI XEROX CO., LTD., Tokyo (JP)

(72) Inventors: Yasuhiro Uehara, Kanagawa (JP); Kazuyoshi Itoh, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/431,196

(22) Filed: Feb. 13, 2017

(65) Prior Publication Data

US 2017/0351207 A1 Dec. 7, 2017

(30) Foreign Application Priority Data

Jun. 2, 2016 (JP) ..... 2016-111177

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2053; G03G 15/2078; H01H 37/761; H01H 37/043; H01H 37/10; H01H 37/18; H01H 37/22–37/30
USPC ..... 399/33, 328
See application file for complete search history.

(56) References Cited

U.S. PATENT DOCUMENTS 3,859,616 A * 1/1975 Ladany ..... G01K 5/62 200/61.06
4,495,481 A * 1/1985 Hickling ..... H01H 37/10 337/349
5,072,327 A * 12/1991 Knollman ..... H02H 3/04 340/664
2005/0140491 A1* 6/2005 Uehara ..... H01H 37/761 337/401
2017/0030420 A1* 2/2017 Konishi ..... F16D 27/14
2017/0242379 A1* 8/2017 Uehara ..... G03G 15/2053

FOREIGN PATENT DOCUMENTS

JP 2008-028089 A 2/2008
JP 2010-086675 A 4/2010
JP 2011-204516 A 10/2011

* cited by examiner

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

A fixing device includes a planar heating element and a thermal fuse. The planar heating element is configured to heat a fixing member that fixes a toner image to a recording medium. The thermal fuse includes a fuse element configured to be in contact with the heating element, and an elastic member configured to support the fuse element on a support body by a tension at which a fusing temperature of the fuse element is lower than a rated fusing temperature.

6 Claims, 6 Drawing Sheets

FIXING DEVICE AND IMAGE FORMING APPARATUS COMPRISING A THERMAL FUSE INCLUDING A FUSE ELEMENT SUPPORTED BY AN ELASTIC MEMBER

CROSS-REFERENCE TO RELATED APPLICATIONS

This application is based on and claims priority under 35 USC 119 from Japanese Patent Application No. 2016-111177 filed Jun. 2, 2016.

BACKGROUND

Technical Field

The present invention relates to a fixing device and an image forming apparatus.

SUMMARY

According to an aspect of the invention, a fixing device includes a planar heating element and a thermal fuse. The planar heating element is configured to heat a fixing member that fixes a toner image to a recording medium. The thermal fuse includes a fuse element configured to be in contact with the heating element, and an elastic member configured to support the fuse element on a support body by a tension at which a fusing temperature of the fuse element is lower than a rated fusing temperature.

BRIEF DESCRIPTION OF THE DRAWINGS

Exemplary embodiments of the present invention will be described in detail based on the following figures, wherein.

DETAILED DESCRIPTION

Figure 1:
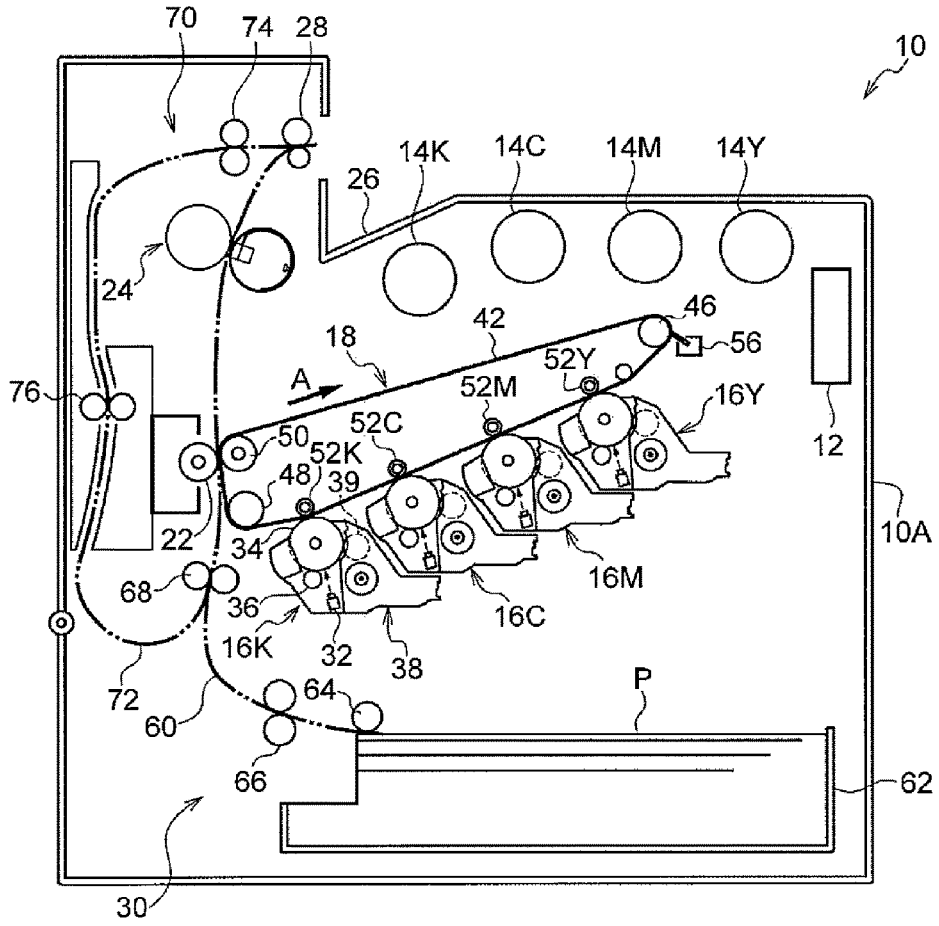
FIG. 1 is a view illustrating a configuration example of an image forming apparatus.

Hereinafter, yellow will be represented by Y, magenta will be represented by M, cyan will be represented by C, and black will be represented by K. When it is necessary to distinguish respective constituent elements and toner images (images) from color to color, a color sign Y, M, C, or K corresponding to each color will be added to the end of a reference number and descriptions will be made with reference thereto. In addition, hereinafter, when collectively referring to the respective constituent elements and toner images without distinguishing the constituent elements and toner images from color to color, a color sign will be omitted at the end of a reference numeral and descriptions will be made thereon.

(Overall Configuration)

As illustrated in FIG. 1, inside an apparatus body 10A of an image forming apparatus 10, an image processing unit 12 is provided to perform an image processing of converting input image data into gradation data of four colors of Y, M, C, and K.

In addition, at the center side of the apparatus body 10A, image forming units 16 of respective images, which respectively form color toner images, are arranged to be spaced apart from each other in an inclined direction relative to the horizontal direction. In addition, a primary transfer unit 18 is provided at the vertically upper side of the image forming units 16 of the respective colors. Toner images formed by the image forming units 16 of the respective colors are transferred to the primary transfer unit 18 in a superimposed manner.

In addition, a secondary transfer roller 22 is provided at a lateral side (the left side of FIG. 1) of the primary transfer unit 18. The secondary transfer roller 22 transfers the toner images, which are transferred to the primary transfer unit 18 in the superimposed manner, to paper P which is an exemplary recording medium transported along a transport path 60 by a supply transport unit 30 which will be described later.

A fixing device 24 is provided downstream of the secondary transfer roller 22 in the transport direction of the paper P (hereinafter, referred to as a "paper transport direction"). The fixing device 24 fixes the toner images, which are transferred to the paper P, on the paper P by heat and pressure.

In addition, a discharge roller 28 is provided downstream of the fixing device 24 in the paper transport direction. The discharge roller 28 discharges the paper P having the toner images fixed thereto to a discharge unit 26 provided in the upper portion of the apparatus body 10A of the image forming apparatus 10.

Meanwhile, the supply transport unit 30 is provided vertically below and lateral to the image forming units 16. The supply transport unit 30 supplies and transports the paper P. In addition, above the primary transfer unit 18 in the vertical direction, four toner cartridges 14K to 14Y by colors are arranged side by side in an apparatus width direction. The toner cartridges 14K to 14Y are attachable to/detachable from the apparatus body 10A from the front side of the apparatus body 10A and are charged with a toner to be replenished to a developing device 38. The toner cartridge 14 of each color has, for example, a cylindrical shape extending in an apparatus depth direction. Each toner cartridge 14 is connected to one of the developing devices 38 of the respective colors through a supply pipe (not illustrated).

(Image Forming Unit)

As illustrated in FIG. 1, all of the image forming units 16 of the respective colors are configured to be substantially the same as each other. In addition, each image forming unit 16 includes a rotating cylindrical image carrier 34 and a charging unit 36 that charges the surface of the image carrier 34.

In addition, the image forming unit 16 includes a light emitting diode (LED) head 32 that irradiates the surface of the charged image carrier 34 with exposure light. In addition, the image forming unit 16 includes a developing device 38 that develops an electrostatic latent image, which is formed via the irradiation of exposure light by the LED head 32, using a developer (in the present exemplary embodiment, a negatively charged toner) so as to visualize the electrostatic latent image as a toner image. In addition, the image forming unit 16 includes a cleaning blade (not illustrated) that cleans the surface of the image carrier 34.

A developing roller 39 is disposed in the developing device 38 to face the image carrier 34. The developing device 38 develops an electrostatic latent image, which is formed on the image carrier 34, with a developer using the developing roller 39 to visualize the electrostatic latent image as a toner image.

In addition, the charging unit 36, the LED head 32, the developing roller 39, and the cleaning blade are arranged in this sequence from the upstream side to the downstream side of the image carrier 34 in the rotation direction to face the surface of the image carrier 34.

(Transfer Unit (Primary Transfer Unit/Secondary Transfer Roller))

The primary transfer unit 18 includes an endless intermediate transfer belt 42, and a driving roller 46 on which the intermediate transfer belt 42 is wound. The driving roller 46 is rotationally driven by a motor (not illustrated) to circulate the intermediate transfer belt 42 in the direction indicated by the arrow A. In addition, the primary transfer unit 18 includes a tension imparting roller 48 and an assist roller 50. The intermediate transfer belt 42 is wound on the tension imparting roller 48. The tension imparting roller 48 imparts tension to the intermediate transfer belt 42. The assist roller 50 is disposed vertically above the tension imparting roller 48 and driven to rotate by the intermediate transfer belt 42. In addition, the primary transfer unit 18 includes primary transfer rollers 52, which are respectively located opposite to image carriers 34 of the respective colors with the intermediate transfer belt 42 being interposed therebetween.

With this configuration, toner images of the respective colors of Y, M, C, and K, which are sequentially formed on the image carriers 34 of the image forming units 16 of the respective colors, are transferred to the intermediate transfer belt 42 in the superimposed manner by the primary transfer rollers 52 of the respective colors.

In addition, a cleaning blade 56 is disposed opposite to the driving roller 46 with the intermediate transfer belt 42 being interposed therebetween to come in contact with the surface of the intermediate transfer belt 42 so as to clean the surface of the intermediate transfer belt 42.

In addition, the secondary transfer roller 22 is provided opposite to the assist roller 50 with the intermediate transfer belt 42 being interposed therebetween to transfer the toner images, which are transferred to the intermediate transfer belt 42, to the paper P that is being transported. In addition, the secondary transfer roller 22 is grounded, and the assist roller 50 forms a counter electrode of the secondary transfer roller 22. When a secondary transfer voltage is applied to the assist roller 50, the toner images are transferred to the paper P.

(Supply Transport Unit)

The supply transport unit 30 is disposed vertically below the image forming units 16 within the apparatus body 10A, and includes a paper feeding member 62 in which plural sheets of paper P are loaded.

In addition, the supply transport unit 30 includes a paper feeding roller 64, a separation roller 66, and a registration roller 68. The paper feeding roller 64 delivers paper P loaded in the paper feeding member 62 to the transport path 60. The separation roller 66 separates the paper P delivered by the paper feeding roller 64 one by one. The registration roller 68 adjusts a transport timing of the paper P. In addition, the respective rollers are arranged in this order from the upstream side to the downstream side of the paper transport direction.

With this configuration, the paper P supplied from the paper feeding member 62 is delivered at a predetermined timing to a contact portion (secondary transfer position) between the intermediate transfer belt 42 and the secondary transfer roller 22 by the rotating registration roller 68.

(Image Forming Process)

First, gradation data of the respective colors are sequentially output from the image processing unit 12 to LED heads 32 of the respective colors. Then, the surfaces of the image carrier 34 charged by the charging units 36 are irradiated with exposure lights that are respectively emitted from the LED heads 32 based on the gradation data. Thus, electrostatic latent images are formed on the surfaces of the image carriers 34. The electrostatic latent images formed on the image carriers 34 are developed by the developing devices 38 of the respective colors, respectively, and are visualized as toner images of the respective colors of Y, M, C, and K, respectively.

In addition, the toner images of the respective colors formed on the image carriers 34 are transferred to the circulating intermediate transfer belt 42 in the superimposed manner by the primary transfer rollers 52 of the primary transfer unit 18.

The toner images of the respective colors, which are transferred to the intermediate transfer belt 42 in the superimposed manner, are secondarily transferred to paper P at a secondary transfer position by the secondary transfer roller 22 when the paper P is transported to the secondary transfer position along the transport path 60 from the paper feeding member 62 by the paper feeding roller 64, the separation roller 66, and the registration roller 68.

In addition, the paper P, to which the toner image is transferred, is transported to the fixing device 24, and the toner image is fixed to the paper P by the fixing device 24. Then, the paper P, to which the toner image is fixed, is discharged to the discharge unit 26 by the discharge roller 28.

Meanwhile, when forming images on opposite sides of paper P, the paper P, on which the toner image is fixed to one side (the front side) by the fixing device 24, is not directly discharged to the discharge unit 26 by the discharge roller 28, and the paper transport direction of the paper P is switched by reversely rotating the discharge roller 28. Then, the paper P is transported along a double-sided transport path 72 by transport rollers 74 and 76.

The paper P transported along the double-sided transport path 72 is reversed upside down and transported again to the registration roller 68. Then, after a toner image is transferred and fixed to the other side (the back side) of the paper P, the paper P is discharged to the discharge unit 26 by the discharge roller 28.

In addition, in the image forming apparatus 10, the transport speed of the paper P may particularly be referred to as a "process speed," and the process speed of the image forming apparatus 10 is predetermined. In this case, as the process speed of the image forming apparatus 10 is higher, the number of papers, on which images are formed per unit time, is increased.

In addition, there are various kinds of image forming apparatuses 10, such as one corresponding to only a single process speed, and another one corresponding to plural process speeds.

(Fixing Device)

Next, the fixing device 24 of the image forming apparatus 10 will be described in detail.

Figure 2:
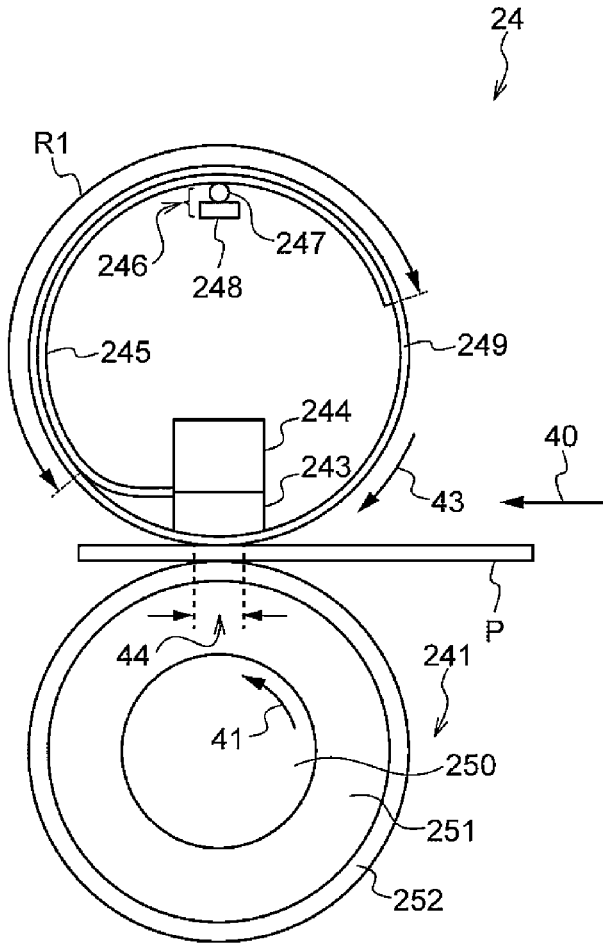
FIG. 2 is a view illustrating an exemplary configuration of a fixing device when viewed along a rotation axis.

As illustrated in FIG. 2, the fixing device 24 according to the present exemplary embodiment includes a pressurizing roller 241 and a fixing belt 249 which is an example of an endless belt. The pressurizing roller 241 is rotated in the direction indicated by the arrow 41 by a driving device (a motor which is not illustrated). The fixing belt 249 contacts with the pressurizing roller 241 and is thus rotated following the rotation of the pressurizing roller 241 in the direction indicated by the arrow 43. In addition, as will be described later, the fixing belt 249 is heated to a preset temperature by a heater 245 provided therein. In addition, the temperature of the fixing belt 249 is set based on, for example, the process speed of the paper P.

The paper P transported in the direction indicated by the arrow 40 is pinched into a nip portion 44, which is formed by the pressurizing roller 241 and the fixing belt 249, while the pressurizing roller 241 and the fixing belt 249 of the fixing device 24 are rotated together. Then, the fixing device 24 fixes the toner image to the paper P by, while heating the toner image transferred to the paper P using the fixing belt 249, pressing the toner image against the paper P using pressing force generated by the pressurizing roller 241 and the fixing belt 249 when the paper P is pinched into the nip portion 44. Thus, the fixing belt 249 is one example of a fixing member for fixing the toner image on the paper P.

The fixing belt 249 is an endless belt having a cylindrical shape and includes a fixing pad 243, an inner structure 244, the heater 245, and a thermal fuse 246 therein. The fixing belt 249 is disposed such that the height direction of the cylinder follows the direction orthogonal to the transport direction of the paper P which is indicated by the arrow 40, i.e. the width direction of the paper P. Hereinafter, the direction of the fixing belt 249, which is disposed along the width direction of the paper P, is referred to as the "width direction of the fixing belt 249."

In addition, a planar heater 245 is mounted on the fixing belt 249 to be in contact with the fixing belt 249 over a predetermined length thereof. To this end, one end of the heater 245 is sandwiched and fixed between the fixing pad 243 and the inner structure 244, and the other end of the heater 245 is brought into contact with the fixing belt 249 as a free end rather than being fixed.

The heater 245 generates heat depending on, for example, the magnitude of a current supplied to the heater 245, and heats the fixing belt 249, which is in contact with the heater 245. Although the planar heater 245 is rounded to contact the fixing belt 249 and is formed substantially in the cylindrical shape. At this time, the heater 245 is formed such that the diameter of the rounded heater 245 is larger than the diameter of the fixing belt 249. When the heater 245 formed as described above is mounted inside the fixing belt 249, restoration force, by which the heater 245 returns to an original shape thereof, acts on the fixing belt 249, thereby causing the heater 245 to be naturally brought into close contact with the fixing belt 249.

In addition, like the heater 245, for example, a heating element having a property of being deformable depending on the shape of a member to be heated (the fixing belt 249 in the present exemplary embodiment) may be referred to as a "flexible heater."

The fixing pad 243 is one example of a pressing member formed of, for example, a liquid crystal polymer, and is provided at a position facing the pressurizing roller 241. The nip portion 44 is formed by the pressurizing roller 241 and the fixing pad 243. The surface of the fixing pad 243 facing the nip portion 44 presses the paper P together with the pressurizing roller 241 while contacting with the rotating fixing belt 249, thereby fixing the toner image transferred to the paper P to the paper P.

The inner structure 244 is provided, for example, on the top of the fixing pad 243 so that one end of the heater 245 is sandwiched together with the fixing pad 243. In addition, the inner structure 244 includes, for example, a circuit for supplying current to the heater 245 (hereinafter, referred to as a "current circuit").

In addition, the linear thermal fuse 246 is provided on an opposite surface of the heater 245 (hereinafter, referred to as "the inner surface of the heater 245") to the surface contacting with the fixing belt 249, so as to be in contact with the heater 245 along the width direction of the fixing belt 249. Specifically, the thermal fuse 246 includes a fuse element 247 and a support body 248 on which the fuse element 247 is mounted. The fuse element 247 is provided to be in contact with the inner surface of the heater 245. The fuse element 247 detects the temperature of the heater 245.

The pressurizing roller 241 is a driving roller having a diameter of about 28 mm. The pressurizing roller 241 includes a metallic rotating shaft 250, a silicone rubber layer 251, and a tetrafluoroethylene-perfluoroalkyl vinyl ether copolymer (PFA) tube 252. The rotating shaft 250 is a cylindrical body rotated by a drive power of a motor (not illustrated) in the direction indicated by the arrow 41. The silicone rubber layer 251 has a thickness of about 5 mm and is wound around the circumferential surface of the rotating shaft 250. The outer surface of the silicone rubber layer 251 is covered with the PFA tube 252. An elastic material (e.g., the silicone rubber layer 251) is wound around the circumferential surface of the rotating shaft 250. Thus, when the paper P is pressed by the nip portion 44, the pressurizing roller 241 presses the paper P while being deformed by the reaction force against the pressing force of the paper P.

In the fixing device 24 according to the present exemplary embodiment, for example, the length of each of the pressurizing roller 241 and the fixing belt 249 in the width direction of the paper P is about 200 mm, and the length of the heater 245 in the width direction of the paper P is set to, for example, about 220 mm to be greater than the length of the fixing belt 249 in the width direction of the paper P. This configuration is adopted to suppress the temperature of the fixing belt 249 from becoming uneven as the temperature of the end of the fixing belt 249 is lowered than the temperature of the central portion of the fixing belt 249 when the fixing belt 249 and the heater 245 have the same length in the width direction of the paper P.

In addition, the length of the heater 245 from the one end thereof fixed by the fixing pad 243 and the inner structure 244 to the free end is about 55 mm. The range of about 45 mm thereof (i.e., the range indicated by R1 in FIG. 2) is in contact with the fixing belt 249 along the circumferential direction of the fixing belt 249. In the range within which the fixing belt 249 and the heater 245 are in contact with each other, the fixing belt 249 is pressed against the heater 245 by a force of about 1.2 kg which is the restoration force of the heater 245. Thereby, the fixing belt 249 is in close contact with heater 245.

In addition, when an alternating current voltage of 100 V is applied to the heater 245 according to the present exemplary embodiment, the rated power is about 700 W.

In addition, the length of the nip portion 44 of the fixing device 24 according to the present exemplary embodiment is about 8 mm in the transport direction of the paper P, and the pressing force of the paper P in the nip portion 44 is adjusted to about 20 kg.

In addition, the aforementioned specific numerical values related to the fixing device 24 are given by way of an example, and the present exemplary embodiment is of course not limited thereto.

Figure 3:
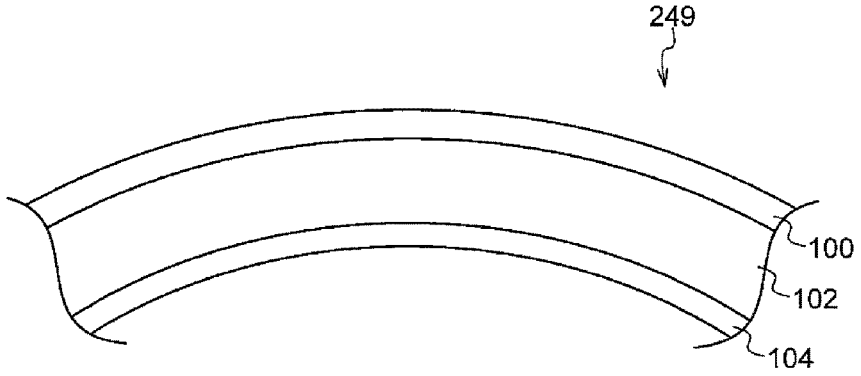
FIG. 3 is a view illustrating an exemplary cross-sectional configuration of a fixing belt.

Next, the details of the fixing belt 249 will be described. FIG. 3 is a view illustrating an exemplary cross-sectional configuration of the fixing belt 249. As illustrated in FIG. 3, the fixing belt 249 includes three layers, i.e. a surface release layer 100, an elastic layer 102, and a base member layer 104, in this order from one surface thereof that comes into contact with the paper P to the other surface thereof that is in contact with the heater 245.

The surface release layer 100 is formed of, for example, tetrafluoroethylene-perfluoroalkyl vinyl ether polymer (PFA), polytetrafluoroethylene (PTFE), a silicone copolymer, or a composite thereof, and is configured as a layer having a thickness of about 10 μm or more and less than 50 μm.

The elastic layer 102 is formed of, for example, an elastic material (e.g., silicone rubber) having a hardness of about 10° or more and less than 60°, and is configured as a layer having a thickness of about 100 μm or more and less than 400 μm.

In addition, the base member layer 104 is formed of, for example, a resin material (e.g., polyimide) having a thickness of about 50 to 100 μm.

In addition, although an endless belt having a diameter of about 30 mm is used as the fixing belt 249 according to the present exemplary embodiment, the present exemplary embodiment is not limited in relation to the diameter of the fixing belt 249.

Figure 4:
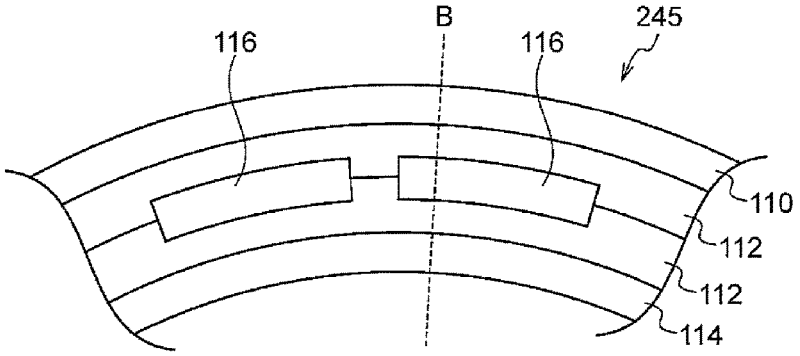
FIG. 4 is a view illustrating an exemplary cross-sectional configuration of a heater.

Next, the details of the heater 245 will be described. FIG. 4 is a view illustrating an exemplary cross-sectional configuration of the heater 245.

As illustrated in FIG. 4, the heater 245 has a five-layered structure including five layers, i.e. a heat conducting layer 110, an insulating layer 112, a heating layer 116, an insulating layer 112, and a support layer 114 in this order from one surface that is in contact with the fixing belt 249 to the inner surface of the heater 245 at the position indicated by the dashed line B. The heater 245 is configured as a flexible heater having a thickness of about 140 μm.

The heat conducting layer 110 is formed of, for example, stainless steel having a thickness of about 30 μm. The heat conducting layer 110 conducts heat of the heating layer 116 to the fixing belt 249 by contacting the fixing belt 249, to thereby heat the fixing belt 249.

In the insulating layers 112, for example, a resin material (e.g., polyimide) having a thickness of about 25 μm is used. The heating layer 116 is sandwiched between the two insulating layers 112 so that the heating layer 116 is electrically insulated.

In the heating layer 116, for example, stainless steel having a thickness of about 30 μm, is used as in the heat conducting layer. The heating layer 116 is connected to, for example, a current circuit provided in the inner structure 244, and has a structure in which stainless steel generates heat depending on the magnitude of a supplied current when the current is supplied from the current circuit.

In the support layer 114, for example, stainless steel having a thickness of about 30 μm is used as in the heat conducting layer 110 and the heating layer 116. The support layer 114 covers the insulating layer 112, reinforces the structural strength of the heater 245, and supports the heat conducting layer 110, the insulating layer 112, and the heating layer 116.

The heater 245 having the above-described configuration is formed into a cylindrical shape having a diameter of about 35 mm, and is in close contact with the fixing belt 249 to heat the fixing belt 249. In addition, the thermal fuse 246 is provided such that the fuse element 247 is in contact with the support layer 114.

Figure 5:
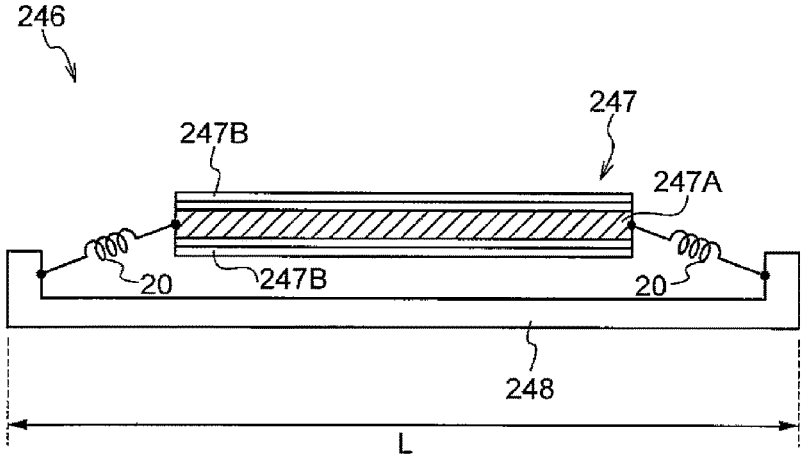
FIG. 5 is a schematic view illustrating an exemplary configuration of a thermal fuse when viewed along a transport direction of a paper.

Next, the details of the thermal fuse 246 will be described. FIG. 5 is a diagram illustrating a structure of the thermal fuse 246 when viewed along the transport direction of the paper P.

As illustrated in FIG. 5, the thermal fuse 246 includes a fuse element 247 and the support body 248. The fuse element 247 is in contact with the support layer 114 of the heater 245 and fused when the temperature of the heater 245 becomes equal to or higher than an allowable temperature. The support body 248 supports the fuse element 247.

One end of a conductive elastic member 20 (e.g., a metal spring) is mounted on each of the opposite ends of the fuse element 247 in the width direction of the fixing belt 249, and the other end of the elastic member 20 is mounted on the support body 248. Thus, the fuse element 247 is mounted on the support body 248 in a form of being pulled from the opposite ends thereof by the elastic members 20. In addition, pulling the fuse element 247 using the elastic members 20 to mount the fuse element 247 on the support body 248 is referred to as "stretching the fuse element 247."

The other end of each elastic member 20 mounted on the support body 248 is connected to a connection line (not illustrated). In addition, the connection line is connected to, for example, a relay coil (not illustrated) and a direct current power source (not illustrated), which are provided inside the inner structure 244. That is, the fuse element 247, the elastic member 20, the connection line (not illustrated), the relay coil (not illustrated), and the direct current power source (not illustrated) are connected to one another in series to form a closed circuit.

Thus, when the temperature of the heater 245 reaches near the allowable temperature and the fuse element 247 is fused, the current flowing through the closed circuit formed to include the fuse element 247 is interrupted, and a contact driven by the relay coil (not illustrated) is switched off. Therefore, the fixing device 24 may detect the situation in which the temperature of the heater 245 reaches near the allowable temperature.

In addition, in FIG. 5, although the elastic members 20 are mounted on the opposite ends of the fuse element 247 so as to stretch the fuse element 247, the form of stretching the fuse element 247 is not limited thereto. For example, one end of the fuse element 247 may be mounted on the support body 248 using the elastic member 20, and the other end of the fuse element 247 may be directly mounted on the support body 248 using, for example, a conductive wire, rather than using the elastic member 20.

In addition, in the case where it is difficult to directly mount the elastic member 20 to the fuse element 247, the fuse element 247 and the elastic member 20 may be connected to each other via, for example, a conductive wire having a composition to be easily mounted on the fuse element.

Even in the above-described case, the fuse element 247 is stretched on the support body 248 by the elastic members 20. In addition, the positions where the relay (not illustrated)

and the direct current power source (not illustrated) are provided are also not limited to the inside of the inner structure 244.

In addition, as illustrated in FIG. 5, the fuse element 247 is configured by covering a cylindrical fusible body 247A, which has a diameter of about 0.4 mm and a length of about 200 mm in the width direction of the fixing belt 249, with a heat resistant insulating tube 247B, which is formed of, for example, a resin material (e.g., polyimide) and has a hollow shape, of which the inner diameter is about 0.5 mm and the outer diameter is about 0.54 mm.

In addition, flux may be introduced into the space formed by the heat resistant insulating tube 247B and the fusible body 247A. The flux suppresses the degree to which oxidation progresses when the fusible body 247A directly contacts with air, and also suppresses re-oxidation of the fusible body 247A due to the heat of the heater 245.

The fusible body 247A is, for example, an alloy including lead, tin, and silver, and the melting point of the fusible body 247A, i.e. the fusing temperature of the fusible body 247A is set by adjusting the composition ratio of the respective elements. The melting point of the fusible body 247A set by the composition ratio of the respective elements is referred to as a rated fusing temperature of the thermal fuse 246, and the rated fusing temperature of the thermal fuse 246 according to the present exemplary embodiment is set to a temperature $T_0$. At this time, the rated fusing temperature $T_0$ of the thermal fuse 246 may be set to be equal to the allowable temperature of the heater 245.

In addition, the fusible body 247A has a length of about 200 mm in the width direction of the fixing belt 249. When the fusible body 247A is fused, the liquefied fusible body 247A might scatter to the surroundings, thereby being adhered to the fixing device 24. However, the fusible body 247A is covered with the heat resistant insulating tube 247B. Thus, when the fusible body 247A is fused, it is possible to prevent the liquefied fusible body 247A from being scattered to the surroundings and from adhering to the fixing device 24.

In addition, in the above description, although the length of the fuse element 247 is less than the width of the heater 245 by way of an example, the fusible body 247A having a greater length than a width of the heater 245 may be used.

Here, "the width of the heater 245" refers to the length of the heater 245 along the width direction of the fixing belt 249. Thus, the width direction of the heater 245 coincides with the width direction of the fixing belt 249. In addition, the length of the fuse element 247 in the width direction of the fixing belt 249 is referred to as "the length of the fuse element 247."

Next, the action of stretching the fuse element 247 will be described.

Assuming that the fuse element 247 is an ordinary thermal fuse having about several millimeters to several centimeters in length. In this case, when the temperature of the fuse element 247 becomes equal to or higher than the rated fusing temperature $T_0$, the ends of a fusing portion of the fusible body 247A are changed to spherical shapes due to surface tension and separated. Thereby, the fuse element 247 is fused.

However, if the length of the fuse element 247 is increased and becomes, for example, 100 mm or more like the thermal fuse 246 according to the present exemplary embodiment, the fusible body 247A of the fuse element 247 starts to be expanded and loosened due to heat of the heater 245. In this case, the gap between the heat resistant insulating tube 247B and the fusible body 247A is narrowed. Thus, even if the temperature of the fusible body 247A becomes equal to or higher than the rated fusing temperature $T_0$ and the fusible body 247A starts to be fused, the ends of the fusing portion of the fusible body 247A may hardly be changed to the spherical shapes compared to the ordinary thermal fuse 246. That is, as the length of the fuse element 247 is increased, the fuse element 247 may hardly be fused at the preset rated fusing temperature $T_0$ of the thermal fuse 246.

Thus, in the thermal fuse 246 according to the present exemplary embodiment, as illustrated in FIG. 5, the opposite ends of the fuse element 247, more specifically, the opposite ends of the fusible body 247A constituting the fuse element 247 are pulled using the elastic members 20 so as to stretch the fuse element 247. In this case, even if the fusible body 247A of the fuse element 247 is expanded and loosened by the effect of heat by the heater 245, a tension acts on opposite ends of the fusible body 247A to pull the fusible body 247A in the opposite directions.

Thus, when the temperature of the fusible body 247A becomes equal to or higher than the rated fusing temperature $T_0$ and the fusible body 247A starts to be fused, the ends of the fusing portion tend to move away from each other by the tension acting on the opposite ends of the fusible body 247A. Therefore, the fusible body 247A is easily fused compared to the case where the fuse element 247 is mounted on the support body 248 without being stretched.

Figure 6:
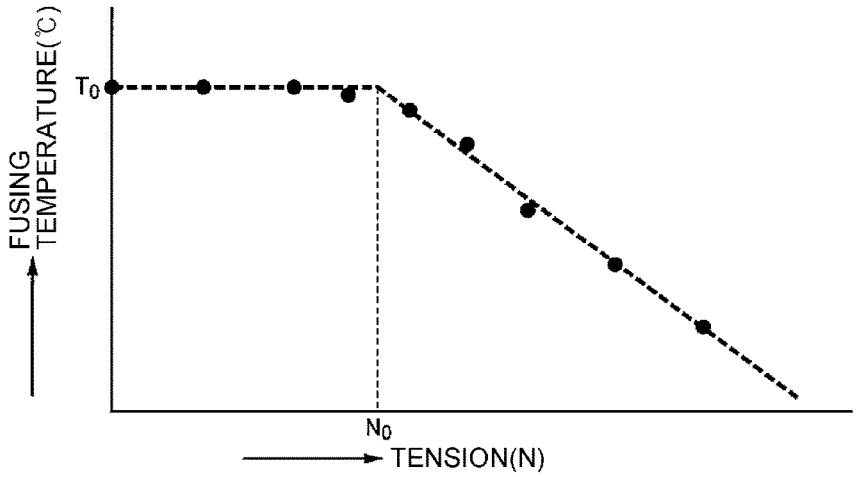
FIG. 6 is a graph representing an exemplary relationship between a tension and a fusing temperature of a fuse element.

Meanwhile, FIG. 6 is a graph illustrating an example of changing the fusing temperature of the fuse element 247 relative to a tension for stretching the fuse element 247. The horizontal axis represents a tension for stretching the fuse element 247, and the vertical axis represents a fusing temperature of the fuse element 247.

As illustrated in FIG. 6, it is found that the fusing temperature of the fuse element 247 falls within an allowable range that may be regarded as the rated fusing temperature $T_0$ when the tension for stretching the fuse element 247 is a specific threshold value $N_0$ or less, and that the fusing temperature tends to be linearly reduced as the tension is increased when the tension for stretching the fuse element 247 exceeds the threshold value $N_0$.

Thus, when the fuse element 247 is stretched by the tension exceeding the threshold value $N_0$, the fusing temperature of the thermal fuse 246 may be set to a specific temperature below the rated fusing temperature $T_0$ of the thermal fuse 246 by the thermal fuse 246 having the rated fusing temperature $T_0$.

Specifically, an elastic member 20 having an elastic modulus that stretches the fuse element 247 using a tension that makes the fusing temperature of the thermal fuse 246 substantially equal to the allowable temperature of the heater 245, which is lower than the rated fusing temperature $T_0$ may be used as the elastic member 20. When a coil spring is used as the elastic member 20, among plural kinds of coil springs having different spring coefficients, for example, based on FIG. 6, a coil spring, which has a spring coefficient that stretches the fuse element 247 using a tension that substantially corresponds to the allowable temperature of the heater 245, which is lower than the rated fusing temperature To, may be used.

That is, for plural kinds of fixing devices 24 in which the allowable temperatures of the heaters 245 are equal to or lower than the rated fusing temperature $T_0$ and different from one another, the same kind of thermal fuses 246, of which the rated fusing temperature is set to $T_0$, may be used. Thus, a cost reduction for the fixing device 24 and the image forming apparatus 10 including the fixing device 24 is expected by commonly using the thermal fuses 246.

In addition, when the image forming apparatus 10 corresponds to plural process speeds, the set temperature of the heater 245 may be changed by a difference among the process speeds.

The process speeds are, for example, classified into a process speed called a "low speed" of about 160 mm/s, a process speed called a "middle speed" of about 260 mm/s, and a process speed called a "high speed" of about 365 mm/s.

When the process speed is the low speed, the time during which the paper P is in contact with the fixing belt 249 heated by the heater 245 is increased compared to the case where the process speed is the middle speed. Thus, when the paper P passes through the fixing device 24 at the same temperature of the heater 245 as that in the case where the process speed is the middle speed in the situation in which the process speed is the low speed, the temperature of the paper P easily becomes a high temperature compared to the case where the process speed is the middle speed. That is, in view of the fact that the quality of an image may be deteriorated when the temperature at which the toner image is fixed to the paper P becomes higher than a specific temperature, the set temperature of the heater 245 may be set to be lower as the process speed is reduced.

On the contrary, when the process speed is the high speed, the time during which the paper P is in contact with the fixing belt 249 heated by the heater 245 is reduced compared to the case where the process speed is the middle speed. Thus, when the paper P passes through the fixing device 24 at the same temperature of the heater 245 as that in the case where the process speed is the middle speed in the situation in which the process speed is the high speed, the temperature of the paper P easily becomes a low temperature compared to the case where the process speed is the middle speed. That is, in view of the fact that the toner image may be hardly fixed on the paper P and the quality of an image may be deteriorated when the temperature at which the toner image is fixed on the paper P becomes lower than the specific temperature, the set temperature of the heater 245 may be set to be higher as the process speed is increased.

Thus, in the image forming apparatus 10 corresponding to the plural process speeds, the fusing temperature of the thermal fuse 246 may be changed according to the allowable temperature that depends on the set temperature of the heater 245, which is set for each process speed.

Figure 7:
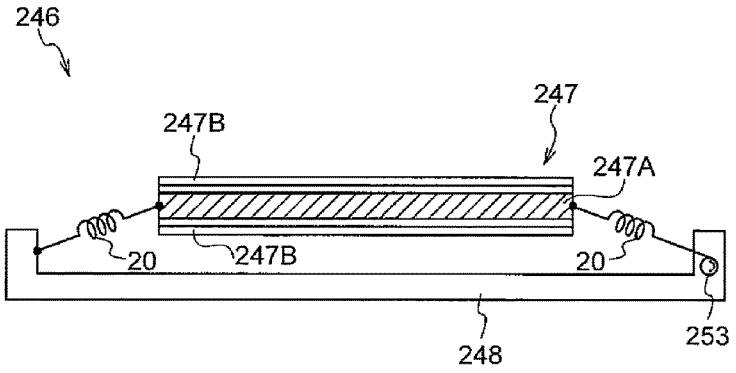
FIG. 7 is a view illustrating an exemplary configuration for changing a tension of a fuse element.

Therefore, for example, as illustrated in FIG. 7, on an end of the support body 248, a traction roller 253 is provided that is rotated by a motor (not illustrated) while winding a wire connected to one end of the elastic member 20. In addition, the winding amount of the wire connected to the elastic member 20 is adjusted by controlling the rotating direction and the rotating amount of the traction roller 253, and the tension for stretching the fuse element 247 is set to a specific value.

For example, it is assumed that the fuse element 247 is stretched using the tension at which the fusing temperature of the thermal fuse 246 becomes the allowable temperature of the heater 245 at the middle process speed.

In the above-described situation, when the process speed of the image forming apparatus 10 is switched to the low speed, the allowable temperature of the heater 245 is set to be lower than the allowable temperature at the middle process speed according to the reduction of the process speed. Thus, the traction roller 253 is rotated in the direction where the winding amount of the wire connected to one end of the elastic member 20 is increased so as to increase the tension for stretching the fuse element 247, thereby reducing the fusing temperature of the thermal fuse 246.

Meanwhile, when the process speed of the image forming apparatus 10 is switched from the middle speed to the high speed, the allowable temperature of the heater 245 is set to be higher than the allowable temperature at the middle process speed. Thus, the traction roller 253 is rotated in the direction in which the winding amount of the wire connected to one end of the elastic member 20 is reduced so as to reduce the tension for stretching the fuse element 247, thereby increasing the fusing temperature of the thermal fuse 246.

That is, for the image forming apparatus 10 of which the process speed is switchable, it is possible to protect the fixing device 24 by detecting plural temperatures using the single thermal fuse 246. Thus, the number of thermal fuses 246 may be reduced compared to a case in which plural thermal fuses 246, of which the rated fusing temperatures are different, are provided in the fixing device 24 according to the allowable temperature of the heater 245, which is changed for each process speed. Thus, the cost reduction in the fixing device 24 and the image forming apparatus 10 including the fixing device 24 is expected. In addition, the size of the fixing device 24 is reduced because the number of thermal fuses 246 is reduced.

In addition, the device of adjusting the tension for stretching the fuse element 247 illustrated in FIG. 7 is given by way of an example, and the present exemplary embodiment is not limited thereto. For example, the traction rollers 253 may be provided on the opposite ends of the support body 248 so that tension is adjusted by pulling the fuse element 247 from the opposite ends thereof. In addition, a mechanism for changing the length L of the support body 248 may be provided on the support body 248 illustrated in FIG. 5 such that when the tension for stretching the fuse element 247 is increased, the length L of the support body 248 may be adjusted to be longer than the length of the current state, and when the tension for stretching the fuse element 247 is reduced, the length L of the support body 248 may be adjusted to be shorter than the length of the current state.

(Check Operation of Thermal Fuse)

Figure 8:
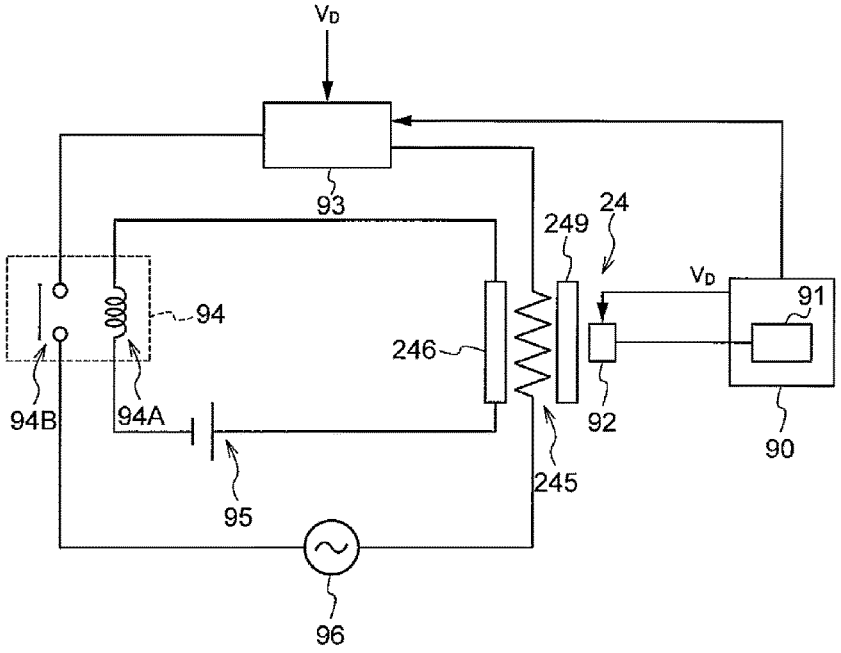
FIG. 8 is a view illustrating an exemplary evaluation circuit for a thermal fuse.

An operation of the thermal fuse 246 according to the present exemplary embodiment is checked using an evaluation circuit illustrated in FIG. 8. As illustrated in FIG. 8, a direct current power supply 95 is connected in series to the thermal fuse 246 having a rated fusing temperature $T_0$ via a coil 94A of a relay 94. In addition, a commercial alternating current power supply 96 is connected in series to the heater 245 of the fixing device 24 via a contact 94B of the relay 94 and a solid state relay 93. In addition, a temperature sensor 92 is disposed around the fixing belt 249, and a CPU 91 in a control circuit 90 is notified of the temperature measured by the temperature sensor 92. The CPU 91 performs a contact control of the solid state relay 93 and controls the electrical conduction time for the heater 245 using information about the temperature measured by the temperature sensor 92 so as to control the temperature of the heater 245.

In addition, in FIG. 8, $V_D$ represents the driving voltage of the temperature sensor 92 and the solid state relay 93. In addition, the temperature sensor 92 is used to measure each of the temperature of the fixing belt 249, the temperature of the heater 245, and the temperature of the thermal fuse 246.

Figure 9:
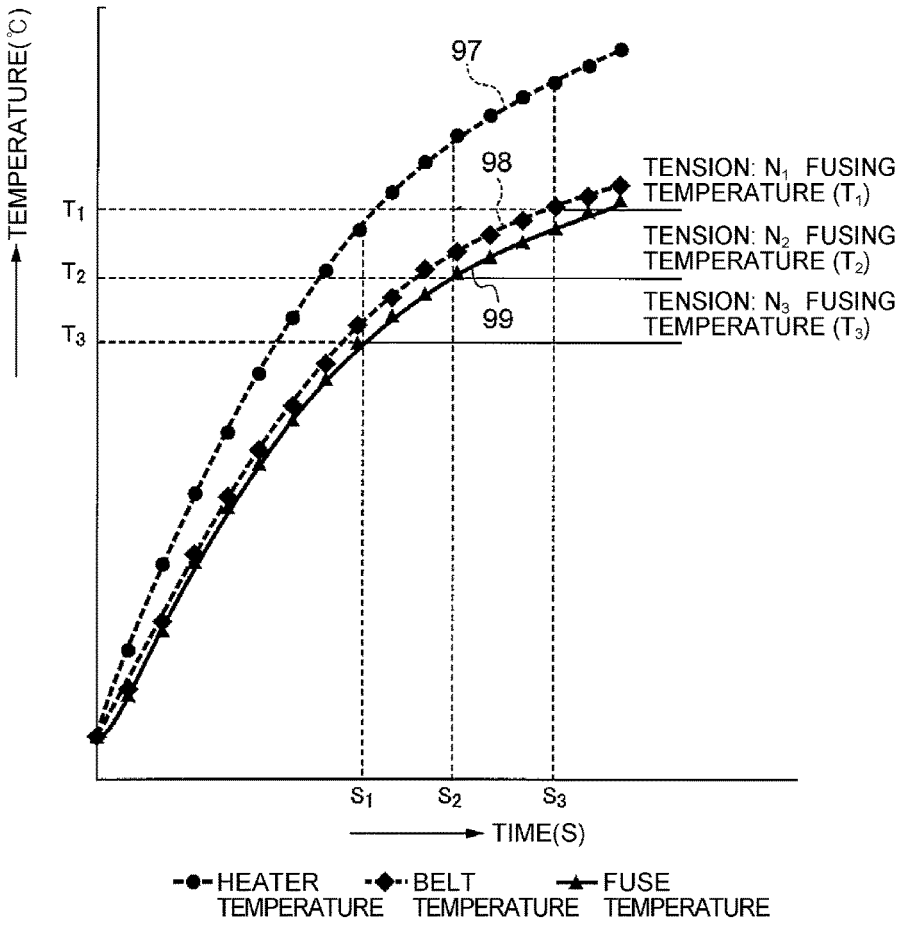
FIG. 9 is a graph representing exemplary variations in temperature of respective parts of a fixing device in the evaluation circuit.

FIG. 9 is a graph representing variations in the respective temperatures of the fixing belt 249, the heater 245, and the thermal fuse 246 in the case where the temperature of the heater 245 is not controlled by the control circuit 90 and the heater 245 is operated at a rated power under the assumption that the control circuit 90 is in failure, and also representing a relationship between the fusing temperature and the fusing time of the thermal fuse 246 in the case where the fuse element 247 of the thermal fuse 246 is stretched by different tensions.

In FIG. 9, the graph 97 represents the temperature of the heater 245, the graph 98 represents the temperature of the fixing belt 249, and the graph 99 represents the temperature of the thermal fuse 246. In addition, in FIG. 9, the horizontal axis represents the electrical conduction time of the heater 245, and the vertical axis represents the temperature. In addition, it is assumed that the magnitude of tension has a relationship of $N_0<N_1<N_2<N_3$, the temperature has a relationship of $T_3<T_2<T_1<T_0$, and the time has a relationship of $S_1<S_2<S_3$. In addition, it is assumed that the temperature $T_1$ is the temperature corresponding to the allowable temperature of the heater 245 when the process speed is the high speed, the temperature $T_2$ is the temperature corresponding to the allowable temperature of the heater 245 when the process speed is the middle speed, and the temperature $T_3$ is the temperature corresponding to the allowable temperature of the heater 245 when the process speed is the low speed.

In the case where the tension for stretching the fuse element 247 is $N_3$, the thermal fuse 246 is fused at the temperature $T_3$ when electrical conduction for the heater 245 is initiated. In this case, the electrical conduction time for the heater 245 is $S_1$.

In addition, in the case where the tension for stretching the fuse element 247 is $N_2$, the thermal fuse 246 is fused at the temperature $T_2$ when the electrical conduction for the heater 245 is initiated. In this case, the electrical conduction time for the heater 245 is $S_2$.

In addition, in the case where that the tension for stretching the fuse element 247 is $N_1$, the thermal fuse 246 is fused at the temperature $T_1$ when the electrical conduction for the heater 245 is initiated. In this case, the electrical conduction time for the heater 245 is $S_3$.

That is, it has been found that the fusing temperature of the thermal fuse 246 is reduced as the tension for stretching the fuse element 247 is increased in the range within which the tension exceeds a threshold value $N_0$.

As described above, with the fixing device 24 according to the present exemplary embodiment, the fusing temperature of the thermal fuse 246 is adjusted using the thermal fuse 246 in which the fuse element 247 is stretched by a larger tension than the threshold value $N_0$. Thus, even in the case of the thermal fuse 246 of which the rated fusing temperature is $T_0$, plural temperatures can be detected because the fusing temperature of the thermal fuse 246 is changed when the tension for stretching the fuse element 247 is adjusted.

The exemplary embodiments are described above. It should be noted that the invention is not limited to the above described exemplary embodiments. Various modifications or improvements may be applied to the exemplary embodiment without departing from the gist of the present invention, and the modified or improved forms are also included in the technical scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a planar heating element configured to heat a fixing member that fixes a toner image to a recording medium; and a thermal fuse including a fuse element configured to be in contact with the heating element, and an elastic member configured to support the fuse element on a support body by a tension at which a fusing temperature of the fuse element is lower than a rated fusing temperature.

2. The fixing device according to claim 1, wherein the elastic member has an elastic modulus that generates the tension corresponding to the fusing temperature that is determined depending on a set temperature of the heating element.

3. The fixing device according to claim 1, further comprising:

an adjustment unit configured to adjust the tension such that the tension is increased as a set temperature of the heating element is decreased and to adjust the tension such that the tension is decreased as the set temperature of the heating element is increased.

4. An image forming apparatus comprising:

an image forming unit configured to form a toner image on a recording medium; and the fixing device according to claim 1, the fixing device configured to fix the toner image, which is formed on the recording medium by the image forming unit, to the recording medium.

5. An image forming apparatus comprising:

an image forming unit configured to form a toner image on a recording medium; and the fixing device according to claim 2, the fixing device configured to fix the toner image, which is formed on the recording medium by the image forming unit, to the recording medium.

6. An image forming apparatus comprising:

an image forming unit configured to form a toner image on a recording medium; and the fixing device according to claim 3, the fixing device configured to fix the toner image, which is formed on the recording medium by the image forming unit, to the recording medium.

* * * * *